US011420081B1

(12) United States Patent
Rossi

(10) Patent No.: US 11,420,081 B1
(45) Date of Patent: Aug. 23, 2022

(54) NASAL FILTRATION APPARATUS

(71) Applicant: William Rossi, Tampa, FL (US)

(72) Inventor: William Rossi, Tampa, FL (US)

( * ) Notice: Subject to any disclaimer, the term of this patent is extended or adjusted under 35 U.S.C. 154(b) by 0 days.

(21) Appl. No.: 17/591,276

(22) Filed: Feb. 2, 2022

(51) Int. Cl.
*A62B 23/06* (2006.01)

(52) U.S. Cl.
CPC ..... *A62B 23/06* (2013.01)

(58) Field of Classification Search
CPC ..... A62B 23/06; A62B 23/025
See application file for complete search history.

(56) References Cited

U.S. PATENT DOCUMENTS 2,161,607 A * 6/1939 Anderson ..... A62B 23/06 128/206.18
2,295,321 A * 9/1942 Anderson ..... A62B 23/06 128/206.18
3,695,265 A * 10/1972 Brevik ..... A41D 13/1176 132/319
4,240,420 A * 12/1980 Riaboy ..... A62B 23/06 55/DIG. 35
4,354,489 A * 10/1982 Riaboy ..... A62B 23/06 55/DIG. 35
5,243,708 A * 9/1993 Vanuch ..... A41D 13/1176 2/9
5,636,629 A * 6/1997 Patterson, Jr. ..... A62B 23/06 128/205.29
11,154,102 B1 * 10/2021 Ahearn ..... A62B 23/025
11,253,014 B1 * 2/2022 Mosaddegh ..... A62B 23/06
2008/0223371 A1 * 9/2008 Guillory ..... A62B 23/06 128/206.18
2017/0303608 A1 * 10/2017 Chen ..... A62B 23/025
2018/0008846 A1 * 1/2018 Chang ..... A62B 23/06
2021/0345696 A1 * 11/2021 Farshoukh ..... A41D 13/113
2021/0346632 A1 * 11/2021 Liu ..... A61M 25/02
2021/0368890 A1 * 12/2021 Brizuela ..... A41D 13/1192

* cited by examiner

*Primary Examiner* — Robert Clemente
(74) *Attorney, Agent, or Firm* — Gulf Coast Intellectual Property Group

(57) ABSTRACT

A nasal filtration apparatus configured to be releasably secured around a nose of a user and provide filtration of air inhaled therethrough. The present invention includes a body having a wall manufactured from a filtration material or layers thereof such as but not limited to polypropylene. The body includes a central support member extending down the middle thereof from the upper edge to the lower edge of the body. The central support member is malleable so as to permit shaping of the body to form a cavity that will accommodate a user's nose therein. The nasal filtration apparatus includes a perimeter edge that is formed and includes material thereon that provide a releasable securing thereof to the skin of the user. A first nostril insert and second nostril insert can be included to provide additional and/or application specific filtration.

8 Claims, 2 Drawing Sheets

NASAL FILTRATION APPARATUS

FIELD OF THE INVENTION

The present invention relates generally to air filtration devices, more specifically but not by way of limitation, an air filtration device that is configured to be superposed a nose of a user and releasably secured therearound wherein the present invention provides filtration of air inhaled into the nose.

BACKGROUND

Airborne bacteria, viruses and other airborne debris particles are everywhere. Bacteria affects the quality of the air individuals breathe. The respiratory system is designed to protect individuals from airborne bacteria and other airborne debris. Only the smallest particles can reach deeply into your lungs, as the respiratory system includes tiny hairs called cilia along the walls of your airways and additionally mucus that coats the same airways. Together the cilia and mucous trap unwanted particles, filtering the air breathed. Cells in the respiratory tract called phagocytes destroy trapped particles and other sources of infection.

The nose processes the air individuals breathe, preparing it for the lungs and throat, which do not tolerate dry air well. As inhaled air passes through the nose, it is moisturized and humidified due to a multiple-layer air pathway with three sets of turbinates (called upper, middle and lower conchae). These are long bony structures covered with a layer of tissue that expand and contract. This path is where drainage and moisture is regulated. The air individuals breathe has all types of debris and unwanted particles to include but not limited to smoke, bacteria, viruses, small bugs. The nose functions to clean the inhaled air of these particles and other debris. The cilia traps the debris which sits in the mucous and is eventually pushed into your throat and swallowed. While the respiratory system does function to provide protection of unwanted airborne contaminants, there are still environments where it is desirable for an individual to protect themselves with additional air filtration to avoid the entry of unwanted or dangerous particles into the body.

Accordingly, there is a need for a nasal filtration apparatus that is configured to be releasably secured around a wearer's nose that is operable to provide enhanced filtration of air passing therethrough.

SUMMARY OF THE INVENTION

It is the object of the present invention to provide a nasal filtration apparatus operable to provide filtration of air passing therethrough wherein the present invention includes a body having a wall.

Another object of the present invention is to provide an air filtration apparatus that is configure to be surroundably mounted a users nose wherein the body wall is formed to create a cavity operable to have a user's nose disposed therein.

A further object of the present invention is to provide a nasal filtration apparatus operable to provide filtration of air passing therethrough wherein the body wall is manufactured from a material capable of air filtration.

Still another object of the present invention is to provide an air filtration apparatus that is configure to be surroundably mounted a users nose wherein the body includes a central support member extending adjacent the bridge of a nose.

An additional object of the present invention is to provide a nasal filtration apparatus operable to provide filtration of air passing therethrough wherein the body can be comprised of two equal halves having an overlapping portion so as to provide adjustment of the size of the body.

Yet a further object of the present invention is to provide an air filtration apparatus that is configure to be surroundably mounted a users nose wherein the body includes a perimeter edge having a pressure sensitive adhesive or similar material thereon that is operable to assist in releasably securing the apparatus when in use.

Another object of the present invention is to a provide a nasal filtration apparatus operable to provide filtration of air passing therethrough wherein the body can further be configured to have nostril filtration inserts positioned adjacent to the nostrils of a user.

An alternate object of the present invention is to provide an air filtration apparatus that is configure to be surroundably mounted a users nose wherein the body can be provided in alternate sizes and colors.

To the accomplishment of the above and related objects the present invention may be embodied in the form illustrated in the accompanying drawings. Attention is called to the fact that the drawings are illustrative only. Variations are contemplated as being a part of the present invention, limited only by the scope of the claims.

BRIEF DESCRIPTION OF THE DRAWINGS

A more complete understanding of the present invention may be had by reference to the following Detailed Description and appended claims when taken in conjunction with the accompanying Drawings wherein:

DETAILED DESCRIPTION

Figure 1:
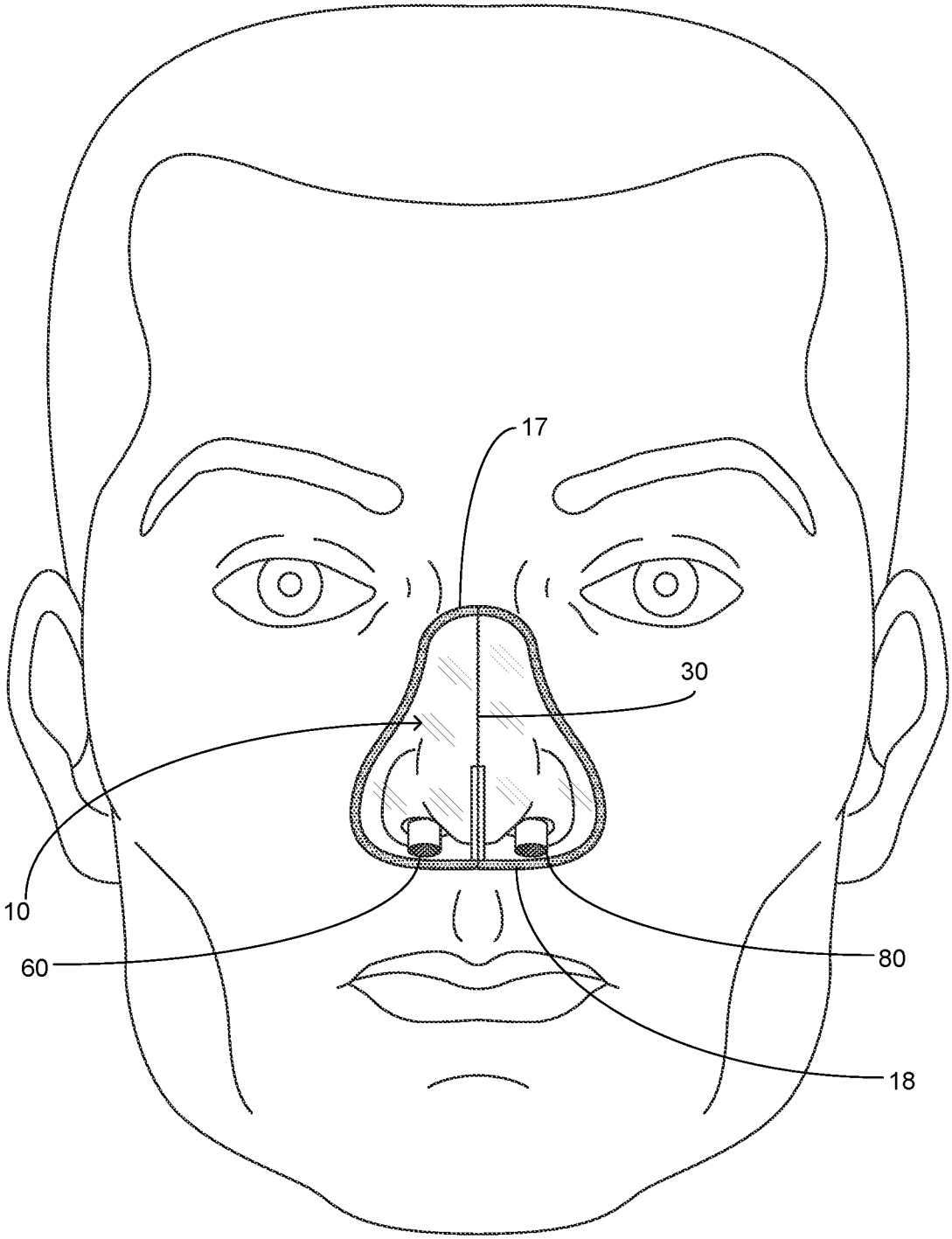
FIG. 1 is a front view of the present invention secured to a user.
Figure 2:
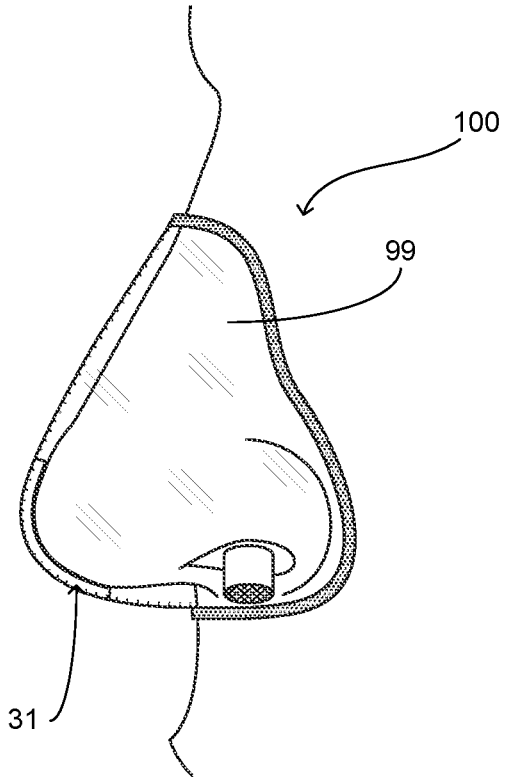
FIG. 2 is a side view of the present invention.
Figure 3:
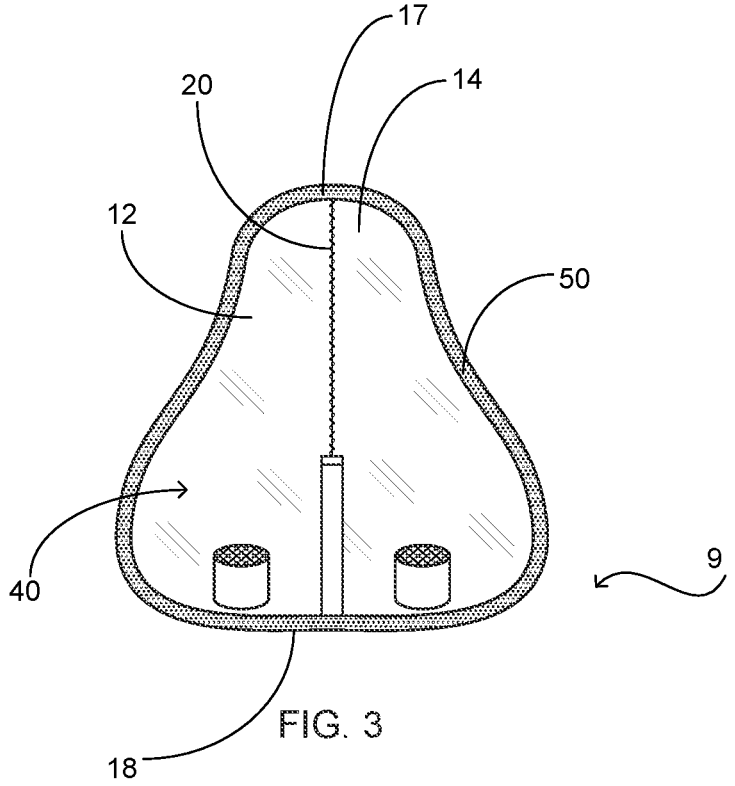
FIG. 3 is a rear view of the present invention.

Referring now to the drawings submitted herewith, wherein various elements depicted therein are not necessarily drawn to scale and wherein through the views and figures like elements are referenced with identical reference numerals, there is illustrated a nasal filtration apparatus 100 constructed according to the principles of the present invention.

An embodiment of the present invention is discussed herein with reference to the figures submitted herewith. Those skilled in the art will understand that the detailed description herein with respect to these figures is for explanatory purposes and that it is contemplated within the scope of the present invention that alternative embodiments are plausible. By way of example but not by way of limitation, those having skill in the art in light of the present teachings of the present invention will recognize a plurality of alternate and suitable approaches dependent upon the needs of the particular application to implement the functionality of any given detail described herein, beyond that of the particular implementation choices in the embodiment described herein. Various modifications and embodiments are within the scope of the present invention.

It is to be further understood that the present invention is not limited to the particular methodology, materials, uses and applications described herein, as these may vary. Furthermore, it is also to be understood that the terminology used herein is used for the purpose of describing particular embodiments only, and is not intended to limit the scope of the present invention. It must be noted that as used herein and in the claims, the singular forms "a", "an" and "the" include the plural reference unless the context clearly dictates otherwise. Thus, for example, a reference to "an element" is a reference to one or more elements and includes equivalents thereof known to those skilled in the art. All conjunctions used are to be understood in the most inclusive sense possible. Thus, the word "or" should be understood as having the definition of a logical "or" rather than that of a logical "exclusive or" unless the context clearly necessitates otherwise. Structures described herein are to be understood also to refer to functional equivalents of such structures. Language that may be construed to express approximation should be so understood unless the context clearly dictates otherwise.

References to "one embodiment", "an embodiment", "exemplary embodiments", and the like may indicate that the embodiment(s) of the invention so described may include a particular feature, structure or characteristic, but not every embodiment necessarily includes the particular feature, structure or characteristic.

Now referring in particular to the Figures submitted herewith, the nasal filtration apparatus 100 includes a body 10. The body 10 is manufactured from a flexible filtration material such as but not limited to a polypropylene plastic polymer. It should be understood within the scope of the present invention that the body 10 could be manufactured from various materials having alternate filtration capabilities. By way of example but not limitation, the body 10 could be manufactured from layers of polypropylene to create N95 properties. Alternatively, it is contemplated within the scope of the present invention that the body 10 could be manufactured of alternate materials to provide filtration that is application specific for applications such as but not limited to inhibiting inhalation of organic vapors.

The body 10 is formed utilizing a first portion 12 and a second portion 14 wherein the first portion 12 and second portion 14 represent generally equal halves of the body 10. The first portion 12 and second portion 14 are releasably secured along the central seam 20 utilizing a suitable material. The first portion 12 and second portion 14 are equally sized and are releasably secured along the central seam 20 so as to provide adjustment of the size of the body 10 so as to permit a user of the nasal filtration apparatus 100 adjustability to create an improved fit. The central seam 20 extends from the upper edge 17 to the lower edge 18. While a central seam 20 has been illustrated and discussed herein, it is contemplated within the scope of the present invention that the body 10 could be provided as a single piece in alternate sizes in order to achieve the objective of providing different users an improved fit.

Extending along the central seam 20 substantially the length thereof is the central support member 30. The central support member 30 functions to provide structural support for the body 10 during use so as to maintain the shape of the nasal filtration apparatus 100. The central support member 30 is manufactured from a lightweight malleable metal wire and extends from the upper edge 17 to the lower edge 18. The central support member 30 is embedded within the body 10 and extends adjacently along the bridge of the nose 99 having a lower portion 31 that encircles the tip of the nose 99. The material properties of the central support member 30 and position thereof provide the desired function of maintaining the shape of the body 10 during utilization of the nasal filtration apparatus 100. It is contemplated within the scope of the present invention that the central support member 30 could be manufactured from various alternate materials. Additionally, it is contemplated within the scope of the present invention that the body 10 could be provided without a central support member 30 or have more than one.

The body 10 is shaped so as to form a cavity 40 wherein the cavity 40 is of suitable size to accommodate a nose 99 therein. As discussed herein, the shape of the body 10 can be created or influenced by the malleable central support member 30 and as such create the cavity 40. The cavity 40 is surrounded by the perimeter edge 50 of the body 10. The perimeter edge 50 has a flat surface and is designed to engage the facial skin of a user of the nasal filtration apparatus 100. The perimeter edge 50 utilizes a pressure sensitive adhesive or similar material to sealably couple the perimeter edge 50 to the facial skin of the user. It is contemplated within the scope of the present invention that the perimeter edge 50 could employ alternate materials and or techniques to provide a sealable coupling with the face of a user of the nasal filtration apparatus 100.

The nasal filtration apparatus 100 further includes a first nostril insert 60 and a second nostril insert 80. The first nostril insert 60 and second nostril insert 80 are positioned at the lower end 9 of the body 10 being placed so as to be proximate the nostrils of a wearer of the nasal filtration apparatus 100. The first nostril insert 60 and second nostril insert 80 are coupled to the body 10 utilizing suitable durable techniques and it is contemplated within the scope of the present invention that first nostril insert 60 and second nostril insert 80 could be configured to be releasably secured to the body 10 so as to facilitate the replacement thereof. While the preferred embodiment of the body 10 is constructed from a filtration capable material as discussed herein, the first nostril insert 60 and second nostril insert 80 can provide additional filtration for specific applications such as but not limited to organic vapors. It should be understood within the scope of the present invention that the nasal filtration apparatus 100 could be provided either with or without the first nostril insert 60 and second nostril insert 80. It should be further understood within the scope of the present invention that the first nostril insert 60 and second nostril insert 80 could be provided in alternate sizes and manufactured from alternate materials capable of filtering different airborne substances so as to provide application specificity.

In the preceding detailed description, reference has been made to the accompanying drawings that form a part hereof, and in which are shown by way of illustration specific embodiments in which the invention may be practiced. These embodiments, and certain variants thereof, have been described in sufficient detail to enable those skilled in the art to practice the invention. It is to be understood that other suitable embodiments may be utilized and that logical changes may be made without departing from the spirit or scope of the invention. The description may omit certain information known to those skilled in the art. The preceding description is, therefore, not intended to be limited to the specific forms set forth herein, but on the contrary, it is intended to cover such alternatives, modifications, and equivalents, as can be reasonably included within the spirit and scope of the invention.

What is claimed is:

1. A nasal filtration apparatus operable to filter air being inhaled therethrough wherein the nasal filtration apparatus comprises:

a body, said body having a wall, said wall being manufactured from a filtrating material, said body having an upper end and a lower end, said body having a perimeter edge, said body being formed in a shape so as to create a cavity, said cavity being of suitable size to accommodate a nose therein, wherein said body further includes a peripheral edge, said peripheral edge circumferentially surrounding said body being integral therewith, said peripheral edge being configured to sealably coupled to a face of a user of the nasal filtration apparatus and wherein said body includes a central seam, said central seam dividing said body into a first portion and a second portion, said first portion and said second portion being equal in size;

a central support member, said central support member being embedded within said body, said central support member extending from said upper end to said lower end of said body;

wherein said body is releasably secured over a nose of a user and is operable to filtered air being inhaled through the nose; and wherein said first portion and said second portion of said body proximate said central seam is releasably secured, said central seam operable to provide adjustment of a size of said body.

2. The nasal filtration apparatus as recited in claim 1, and further including nostril inserts, said nostril inserts being formed in said lower end of said body, said nostril inserts being releasably secured to said body and configured to at least partially journal into nostrils of a user of the nasal filtration apparatus.

3. An air filtration apparatus operable to filter air being inhaled by a user of the air filtration apparatus wherein the air filtration apparatus comprises:

a body, said body having an upper end and a lower end, said body having a shape so as to surroundably mount a user's nose, said body having a first portion and a second portion wherein said first portion and said second portion are contiguous, said first portion of said body and said second portion of said body being configured to be releasably secured along a central seam, said central seam extending from said upper end to said lower end on said body, said body being manufactured from an air filtrating capable material;

a central support member, said central support member being embedded in said body, said central support member extending from said upper end to said lower end, said central support member being adjacent a bridge of the user's nose, said central support member being manufactured from a malleable wire.

4. The air filtration apparatus operable to filter air being inhaled by the user as recited in claim 3, wherein said central seam is located at a midpoint of said body, wherein said central seam is operable to provide adjustment of a size of the body.

5. The air filtration apparatus operable to filter air being inhaled by the user as recited in claim 4, wherein said body further includes a perimeter edge, said perimeter edge configured to engage a portion of a face of the user around the user's nose.

6. The air filtration apparatus operable to filter air being inhaled by the user as recited in claim 5, wherein the perimeter edge includes a pressure sensitive adhesive thereon.

7. The air filtration apparatus operable to filter air being inhaled by the user as recited in claim 6, and further including a first nostril insert, said first nostril insert being secured to said body, said first nostril insert being proximate a nostril of the user's nose and positioned to be journaled thereinto.

8. The air filtration apparatus operable to filter air being inhaled by the user as recited in claim 7, and further including a second nostril insert, said second nostril insert being secured to said body, said second nostril insert being proximate a nostril of the user's nose and positioned to be journaled thereinto.

* * * * *